US006871567B2

(12) United States Patent
Piñana Lopez

(10) Patent No.: US 6,871,567 B2
(45) Date of Patent: Mar. 29, 2005

(54) FUSE AND RELAY PULLER

(75) Inventor: Ramon Piñana Lopez, Valls (ES)

(73) Assignee: Lear Corporation, Southfield, MI (US)

( * ) Notice: Subject to any disclaimer, the term of this patent is extended or adjusted under 35 U.S.C. 154(b) by 29 days.

(21) Appl. No.: 10/604,592

(22) Filed: Aug. 1, 2003

(65) Prior Publication Data

US 2004/0107801 A1 Jun. 10, 2004

(30) Foreign Application Priority Data

Aug. 2, 2002 (WO) ..... WO02/061786 A1

(51) Int. Cl.[7] ..... B25B 27/14
(52) U.S. Cl. ..... 81/3.8; 29/278; 294/99.1
(58) Field of Search ..... 81/3.8; 29/278, 29/739, 758, 764; 294/99.1, 99.2

(56) References Cited

U.S. PATENT DOCUMENTS 3,215,006 A * 11/1965 Urani ..... 81/3.8
4,841,819 A * 6/1989 Williams ..... 81/3.8
5,267,493 A * 12/1993 Yamagata et al. ..... 81/3.8
5,588,341 A * 12/1996 Higuchi ..... 81/3.8
5,666,865 A * 9/1997 Ito ..... 81/3.8
5,751,208 A 5/1998 Martinez ..... 337/198

FOREIGN PATENT DOCUMENTS

EP 710974 A1 * 5/1996 ..... H01H/85/02
JP 07302537 A * 11/1995 ..... H01H/85/02
JP 08138526 A * 5/1996 ..... H01H/85/02
JP 08138527 A * 5/1996 ..... H01H/85/02
JP 10040801 A * 2/1998 ..... H01H/85/02
JP 11185594 A * 7/1999 ..... H01H/85/02
JP 2000317858 A * 11/2000 ..... B25B/27/14
JP 2003317603 A * 11/2003 ..... H01H/85/02

* cited by examiner

*Primary Examiner*—David B. Thomas
(74) *Attorney, Agent, or Firm*—Bill C Panagos

(57) ABSTRACT

The invention relates to an improved fuse and relay puller, consisting of a puller especially adapted to handle given electronic components such as fuses and relays due to the fact that it adjusts to characteristic shapes and dimensions thus making it possible to manipulate said elements in boxes and housings not easily accessible.

2 Claims, 1 Drawing Sheet

FUSE AND RELAY PULLER

BACKGROUND OF INVENTION

The invention relates to an improved fuse and relay puller, consisting of a puller especially adapted to handle given electronic components such as fuses and relays due to the fact that it adjusts to characteristic shapes and dimensions thus making it possible to manipulate said elements in boxes and housings not easily accessible.

For this reason, the present invention will be of special interest for the manufacturers and suppliers of the electric connections equipment sector, as is the case of the auxiliary devices used for the automobile industry.

Currently, the fast and quick performance of electric interconnections is a requirement in the majority of the auxiliary industries where an assembly time reduction is required, which has spurred the development of new types of connectors. In addition, when handling the different components normally used in this industry, such as relays and fuses, it is necessary to work very quickly in assembly and disassembly operations. Furthermore, the physical space limitations make it difficult or impossible on numerous occasions to directly reach said components, their handling requiring specific instruments, such as is the case of the present improved fuse and relay puller.

On one hand, the improved fuse and relay puller described below solves drawbacks associated with known pullers in the State of the Art. On the other hand, in one instrument, it groups the operative functions which required several pullers or instruments, permitting handling both fuses and relays with the same instrument.

In addition, its simple structure makes this instrument an easily acceptable tool, which can also be supplied and stored with a supply of electronic and electromechanical equipment as a very simple, easy to store and of low cost auxiliary tool given the wide variety of applications for which it can be used.

DISCLOSURE OF THE INVENTION

As a result, the present invention, improved fuse and relay puller, fundamentally consists of two parts, coinciding with both ends of a main puller body, one intended for extracting fuses and the opposite intended for extracting relays. On said puller, the main body shape thereof is of a profile composed of two lateral and parallel beams joined together by means of a set of ribs, such that both ends of the puller end in respective elongations of said beams or lateral profiles, forming different protrusions enabling holding different elements or electronic components, such as fuses and relays.

On the other hand, the main body of the puller has grooved surface areas so as to aid in holding the puller during use, its length being long enough to aid in reaching distant or hard to reach fuses and relays.

DETAILED DESCRIPTION

Figure 1:
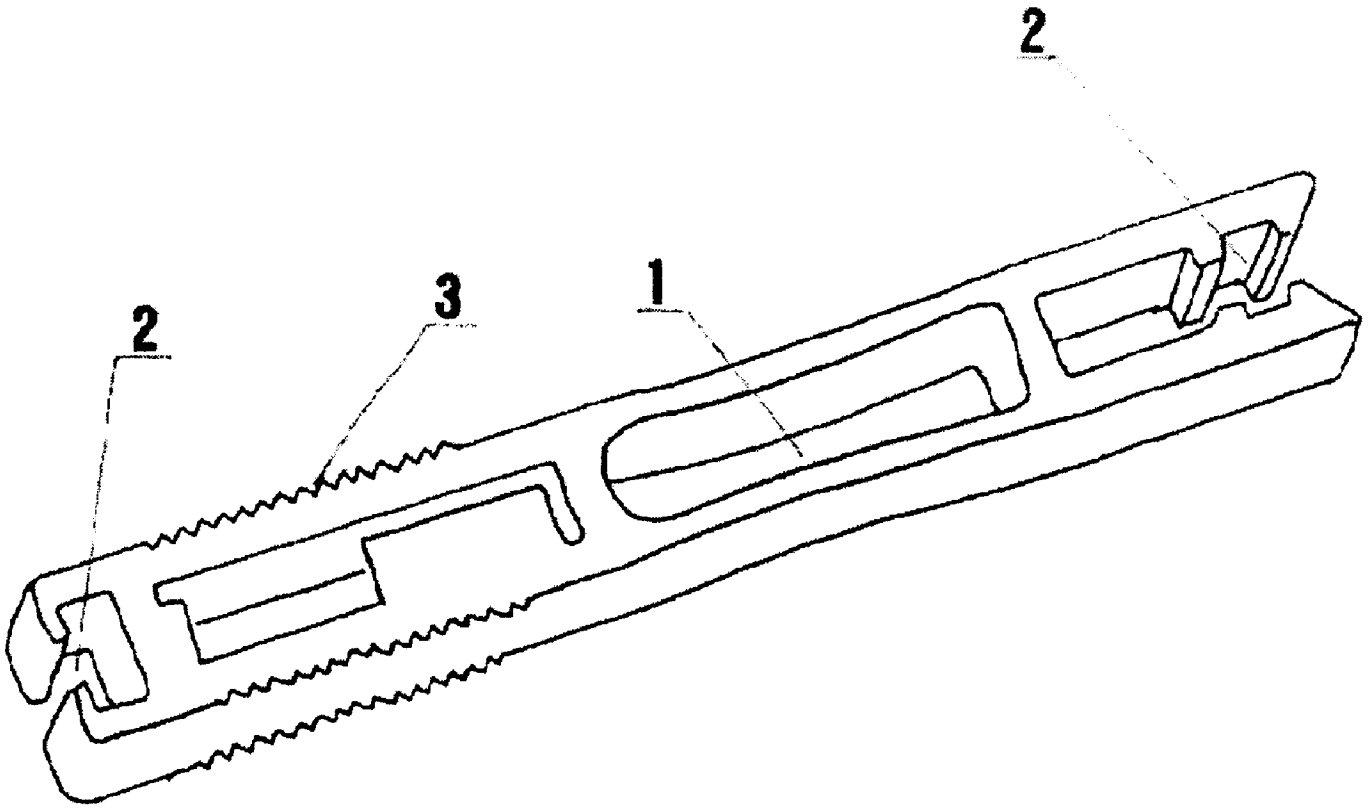
FIG. 1 shows a perspective view of an improved fuse and relay puller.

Next, a detailed description of the improved fuse and relay puller of the present invention will be given with reference to the attached drawing which, as a non-limiting example, shows a preferred embodiment susceptible to all those variations in detail which do no imply any fundamental alteration of the essential features of said invention.

According to the preferred embodiment example shown, the improved fuse and relay puller substantially comprises two parts, coinciding with both ends of a main puller body (1), one intended for extracting fuses (2) and the opposite intended for extracting relays (2). On said puller, the shape of the main body (1) thereof is a profile composed of two lateral and parallel beams joined together by means of a set of ribs, such that on both ends (2), the puller ends in respective elongations of said beams or lateral profiles, form different protrusions which enable holding different elements or electronic components, such as fuses and relays.

Additionally, the main body of the puller (1) has grooved surface areas (3) in order to aid in gripping while performing operations with it, its length being long enough to aid in reaching distant or hard to reach fuses and relays.

Lastly, the shape, materials and dimensions can vary without departing from the scope or spirit of the invention

What is claimed is:

1. A fuse and relay puller, comprising a puller substantially formed of two parts, coinciding with both ends of a main puller body, one end being shaped to extract fuses and the opposite end being shaped to extract relays, said puller being characterized in that the shape of the main body of the puller is a profile composed of two parallel beams joined together by means of a plurality of ribs, and puller ends having lateral profiles, forming different protrusions enabling holding fuses with one end and relays on the other end.

2. A fuse and relay puller according to claim 1, characterized in that the main body of the puller has grooved surface areas in order to aid in gripping while performing operations with said puller, and said puller length being long enough to aid in reaching distant or hard to reach fuses and relays.

* * * * *